US009209577B2

(12) United States Patent
Kim

(10) Patent No.: US 9,209,577 B2
(45) Date of Patent: Dec. 8, 2015

(54) SOCKET FOR CONNECTING JACK HAVING STRUCTURE OF PREVENTING POPPING NOISE

(71) Applicant: DAE HUNG INTERNATIONAL CO., LTD., Incheon (KR)

(72) Inventor: Sun Kuk Kim, Bucheon-si (KR)

(73) Assignees: Sun Kuk Kim, Bucheon-si (KR); Dae Hung International Co., Ltd., Incheon (KR)

( * ) Notice: Subject to any disclaimer, the term of this patent is extended or adjusted under 35 U.S.C. 154(b) by 0 days.

(21) Appl. No.: 14/470,633

(22) Filed: Aug. 27, 2014

(65) Prior Publication Data

US 2015/0079822 A1 Mar. 19, 2015

(30) Foreign Application Priority Data

Sep. 17, 2013 (KR) ..... 10-2013-0111629

(51) Int. Cl.

| | |
|---|---|
| ***H01R 13/703*** | (2006.01) |
| ***G10H 1/18*** | (2006.01) |
| *H01R 24/58* | (2011.01) |
| *H01R 103/00* | (2006.01) |
| *H01R 13/645* | (2006.01) |
| *H01R 9/03* | (2006.01) |
| *H01R 24/38* | (2011.01) |
| *H01R 13/70* | (2006.01) |

(52) U.S. Cl.

CPC ..... *H01R 13/7031* (2013.01); *G10H 1/181* (2013.01); *H01R 9/03* (2013.01); *H01R 13/6456* (2013.01); *H01R 13/70* (2013.01); *H01R 13/7033* (2013.01); *H01R 24/38* (2013.01); *H01R 24/58* (2013.01); *H01R 2103/00* (2013.01); *Y10S 439/9241* (2013.01)

(58) Field of Classification Search

CPC ..... Y10S 439/9241; H01R 2103/00; H01R 13/6456; H01R 9/03; H01R 24/58; H01R 13/7033; H01R 24/38; H01R 13/70

USPC ..... 439/924.1, 924.2, 669, 668

See application file for complete search history.

(56) References Cited

U.S. PATENT DOCUMENTS 5,522,738 A * 6/1996 Lace ..... 439/669

FOREIGN PATENT DOCUMENTS

KR 10-0880824 B1 1/2009

* cited by examiner

*Primary Examiner* — Abdullah Riyami
*Assistant Examiner* — Justin Kratt
(74) *Attorney, Agent, or Firm* — Novick, Kim & Lee, PLLC; Jae Youn Kim

(57) ABSTRACT

Provided is a socket for a connecting jack, which is capable of preventing a popping noise from being generated. The connecting jack includes a connecting part including a tip having an end of a cone shape to perform a function of transmitting a signal through a cable and a sleeve having a cylindrical shape to perform a ground function. The connecting jack is inserted into the socket of a guitar or an amplifier. The socket includes: a cover member buried in a fixing part of the guitar or the amplifier; a signal terminal fixed to the cover member and protruding toward the fixing part; a ground member hinge-coupled in the cover member; and an elastic piece.

5 Claims, 5 Drawing Sheets

SOCKET FOR CONNECTING JACK HAVING STRUCTURE OF PREVENTING POPPING NOISE

BACKGROUND OF THE INVENTION

1. Field of the Invention

The present invention relates to a socket for a connecting jack, which is capable of preventing a popping noise from being generated when a cable connecting jack used for connecting a guitar to an amplifier is inserted into a socket installed in the guitar or the amplifier.

2. Description of the Related Art

In general, for example, a car interior material, that is, a car interior sheet may include a head liner, a door trim, a rear shelf, a sunroof cover, a package tray trim, a luggage cover, an engine cover, a trunk mat, a car mat, and a bonnet. In general, there is a guitar as a kind of percussion for performance. Recently, an electric guitar is used in combination with an amplifier for amplifying an output sound of the guitar at a degree.

In this case, a connecting wire is provided to transmit a sound signal of an electric guitar (hereinafter, referred to as a 'guitar') to an amplifier. Connecting jacks, which are called long jacks, are provided to both ends of the connecting wire. Sockets for receiving the connecting jacks are buried and installed into a body of a guitar and one side of an amplifier.

Such a socket is disclosed in Korea Patent Registration No. 10-0880824. The socket for a connecting jack of an amplifier disclosed in Korea Patent Registration No. 10-0880824 includes a cover member made of a metallic material, installed in a guitar or an amplifier and having a penetration part 112; a supporting member fixed to the penetration part of the cover member and having a through-hole into which an end of a connecting jack of a connecting wire for connecting the guitar to the amplifier is inserted; a plurality of signal terminals provided in the through-hole of the supporting member and electrically connected to the end of the connecting jack when the end of the connecting jack is inserted therein; and a ground terminal provided to a front end of the through-hole of the supporting member and making connect with the end of the connecting jack such that a noise introduced through the end of the connecting jack is removed when the end of the connecting jack is inserted therein.

However, according to the socket disclosed in Korea Patten Registration No. 10-0880824, the socket has a structure which allows the end first to first make contact with the ground terminal when the end of the cable connecting jack is inserted into the socket in state that the cable is connected to the amplifier. Thus there still exists a problem that does not prevent a popping noise which causes the guitar or the amplifier to be damaged from being generated.

SUMMARY OF THE INVENTION

The present invention is made in order to solve the problems occurring in the related art, and an object of the present invention is to provide a socket for a connecting jack having a structure of preventing a popping noise, which is capable of preventing a tip for transmitting a signal from first making contact with the ground of a socket when a cable connecting jacket used for connecting a guitar and an amplifier with each other is inserted into the socket installed in the guitar or the amplifier and of preventing a popping caused when grounds first make contact with each other from occurring.

In order to accomplish the above object, according to the present invention, there is provided a socket for a connecting jack having a structure of preventing a popping noise, wherein the connecting jack includes a connecting part including a tip having an end of a cone shape to perform a function of transmitting a signal through a cable and a sleeve having a cylindrical shape to perform a ground function, and wherein the connecting jack is inserted into the socket of a guitar or an amplifier, the socket including: a cover member buried in a fixing part of the guitar or the amplifier and provided at a center thereof with a through-hole formed in a longitudinal direction; a signal terminal fixed to the cover member and protruding toward the fixing part, such that the signal terminal is electrically connected to the tip when a front portion of the cable connecting jack is inserted into the through-hole; a ground member hinge-coupled in the cover member, provided at a front end thereof with a non-conductive contact roll making contact with the tip and the sleeve of the cable connecting jack, and provided at a rear end thereof with a conductive ground connecting part electrically making contact with the sleeve; and an elastic piece provided in the cover member to press the contact roll toward the through-hole.

The signal terminal is connected to a signal wire, formed at a front portion thereof with a V-shape protrusion part for a signal connection that makes contact with the tip of the connection jack, and formed at a rear portion thereof with a supporting protrusion part inserted into a supporting hole formed in the cover member.

First and second guide holes are formed in the cover member to communicate with the through-hole, such that the conductive ground connecting part and the non-conductive contact roll are introduced into or withdrawn from the through-hole, wherein the ground member is formed in a body thereof with a hinge hole so that the ground member is hinge-coupled into a fixing hole of the cover member through a hinge pin, wherein the body is provided at a front end thereof with the non-conductive contact roll that makes contact with the tip and the sleeve, and wherein the body is provided at a rear end thereof with the conductive contact roll that makes contact with the sleeve and is connected to a ground wire.

The socket further includes a connecting protrusion part formed at a low end of the non-conductive contact roll integrally fixed to a front end of a body of the ground member, wherein the connecting protrusion part is electrically connected with the body such that the connecting protrusion part is enabled to make electrical contact with the elastic piece.

The elastic piece is connected to an active wire such that the elastic piece (140) is usable in an active guitar.

According to the present invention, even though the cable connecting jack is connected to the socket in state that the cable is inserted into the amplifier. The sleeve of the connecting jack first makes contact with the ground member, so that the popping noise, that is caused when the tip which performs the signal transmitting function of a conventional cable connecting jack, first makes contact with the ground member of the socket is prevented from be generated.

In addition, since the popping noise is prevented from being generated, the amplifier or guitar can be prevented from generating a thundering noise and being damaged.

DETAILED DESCRIPTION OF THE INVENTION

Figure 1:
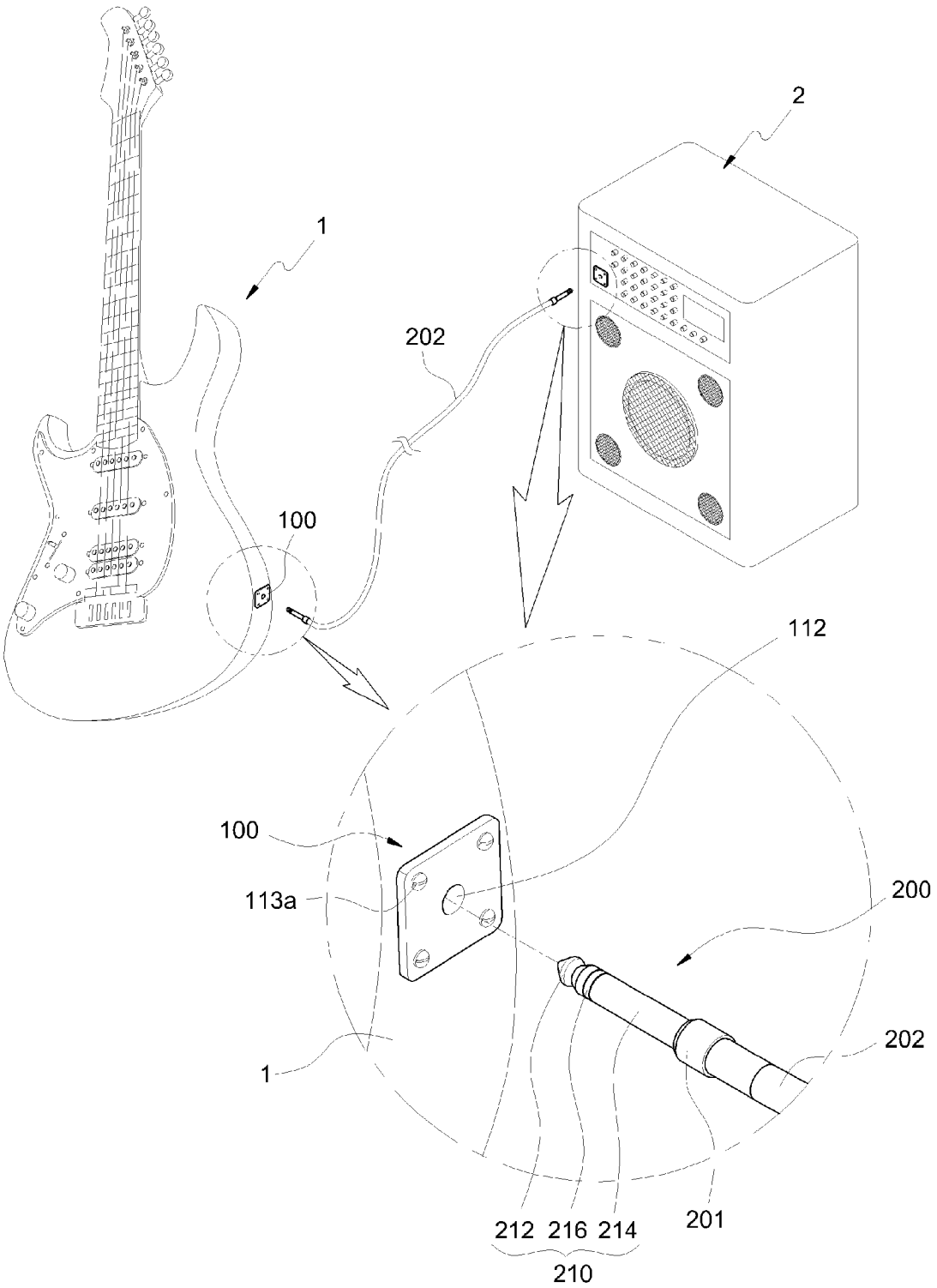
FIG. 1 is a view showing one example of installing a socket for a connecting jack having a structure for preventing a popping noise according to the present invention.

Characteristics of the socket for a connecting jack having a structure for preventing a popping noise according to the present invention will be understood through the embodiments of the present invention described in detail with reference to accompanying drawings below.

Exemplary embodiments of the present invention will be described in detail with reference to accompanying drawings. However, the present invention is not limited to the following embodiments but includes various changes, substitutions and modifications within the technical scope of the present invention.

In the drawings, the same reference numerals, specifically, reference numerals having the same ten-digit and one-digit numbers, or the same ten digit and one-digit numbers as well as the same alphabet represent the members having the same or similar functions. Unless mentioned otherwise, members indicated by the reference numerals in the drawings may be present based on the above standards.

The terms used in the specification are used to explain a specific implementation example (aspect or embodiment), but the terms do not intend to the present invention. Unless the context otherwise requires, the singular expression may not exclude the plural expression.

In the following description, the terms "include" or "comprises" are used to indicate the feature, number, step, operation, elements, parts or combination thereof without excluding other feature, number, step, operation, elements, parts or combination thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
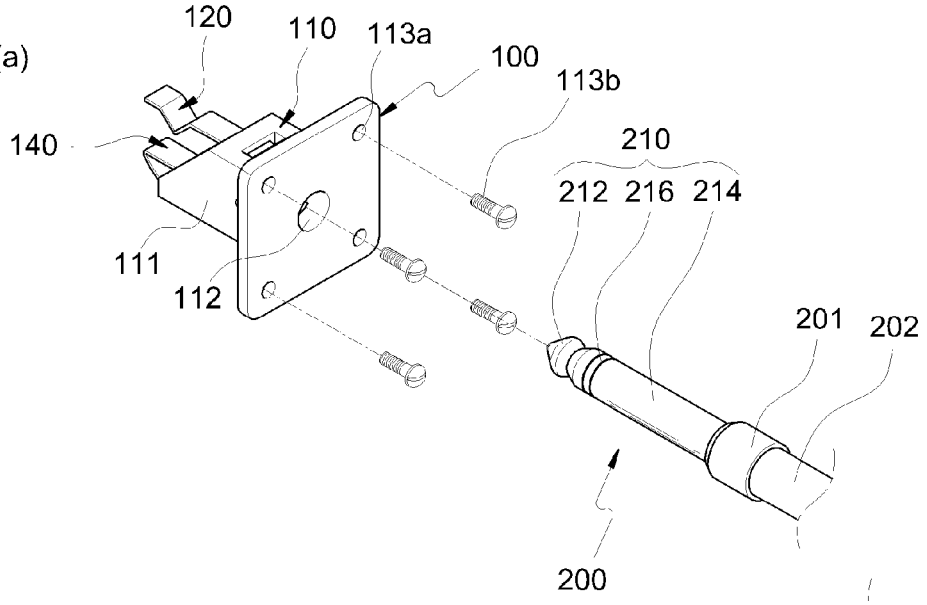
FIG. 2(*a*), FIG. 2(*b*), and FIG. 2(*c*) are rear, front and plan perspective views showing the socket for a connecting jack having a structure for preventing a popping noise according to the present invention.
Figure 2:
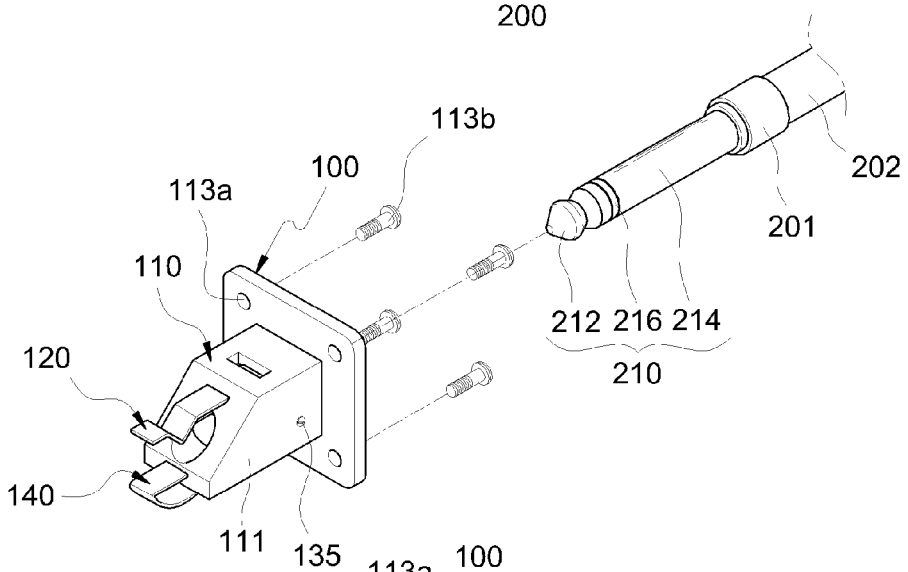
Figure 2:
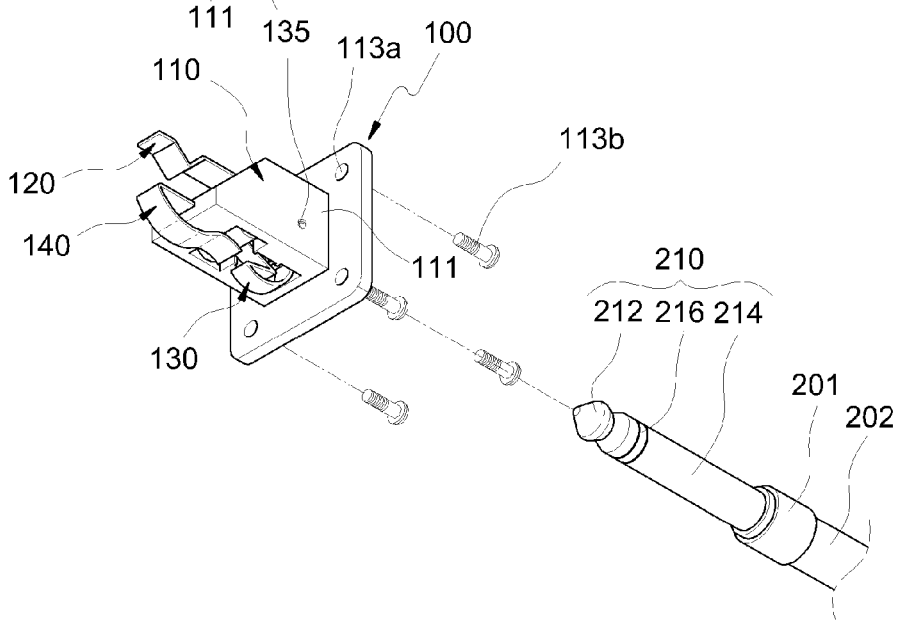
Figure 3:
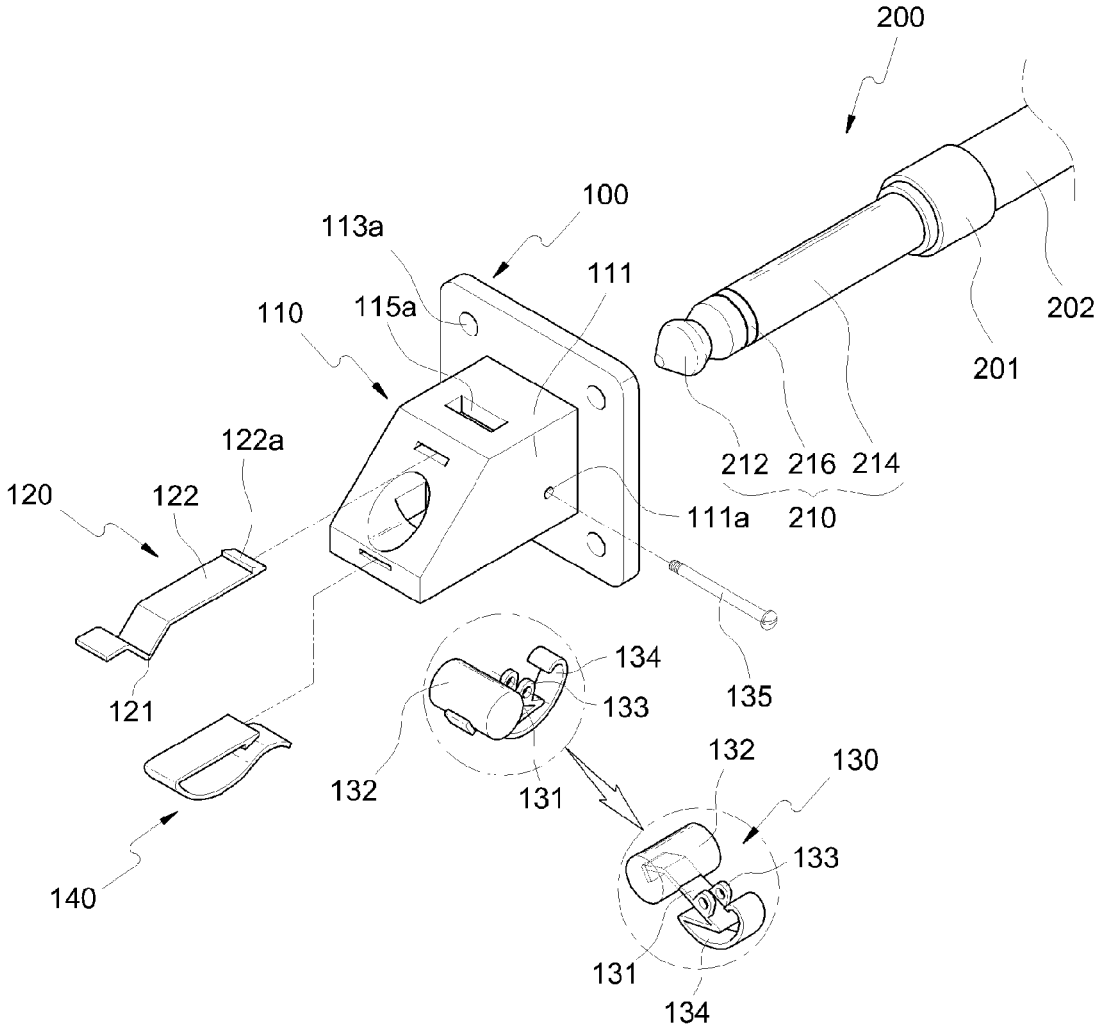
FIG. 3 is an exploded perspective view showing the socket for a connecting jack having a structure for preventing a popping noise according to the present invention.
Figure 4:
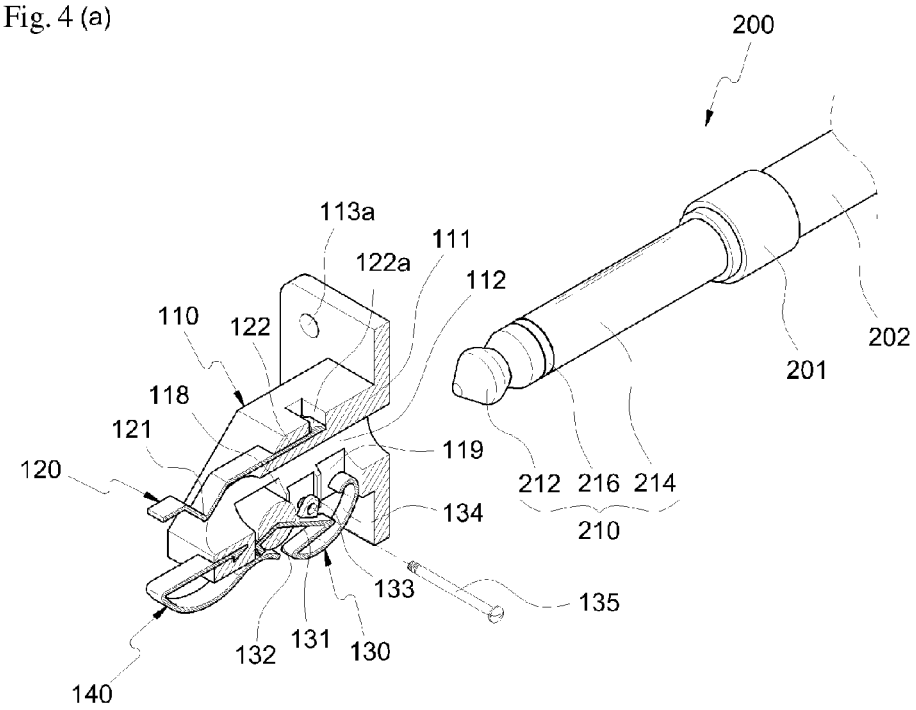
FIG. 4(*a*) and FIG. 4(*b*) are a partial perspective view and a sectional view showing a core portion of the socket for a connecting jack having a structure for preventing a popping noise according to the present invention.
Figure 4:
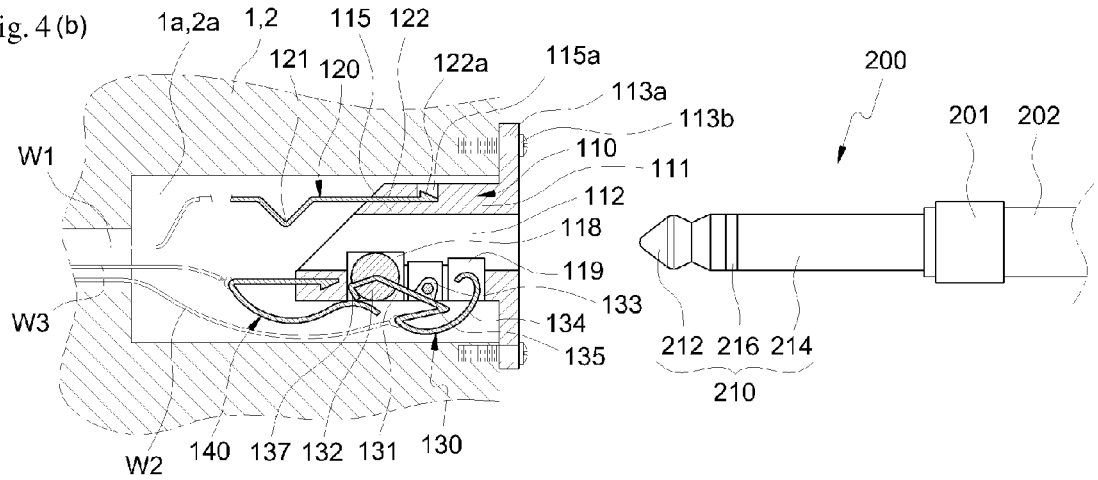

Referring to FIGS. 1 to 4, a socket 100 for a connecting jack having a structure of preventing a popping noise may receive a cable connecting jack 200.

In this case, the connecting jack 200 has a general structure in which a connecting part 210 is formed at a front portion of a housing 201 and includes a tip 212 having an end of a cone shape to perform a function of transmitting a signal through a cable 202, a sleeve 214 having a cylindrical shape to perform a ground function, and an insulating ring 216 for insulating the tip 212 and the sleeve 214 from each other.

Meanwhile, the present invention is provided to absolutely remove a popping noise generated when the connecting jack 200 of the cable 202 is connected to the socket 100 provided in a guitar 1 and an amplifier 2.

In this case, the popping noise is sound generated when the tip 212 of the connecting jack 200 makes contact with the ground while passing through a through-hole 112 in state that the cable 202 is inserted into the guitar 1 or the amplifier 2. Thus, in order to prevent the popping noise from being generated, the present invention allows the sleeve 214 to first make contact with a ground functional portion of the socket 100.

Meanwhile, the guitar 1 is classified into a passive type and an active type, but the present invention may be applied to both types.

Thus, the socket 100 for a connecting jack having a structure of preventing a popping noise according to the present invention includes a cover member 110 buried in a fixing part 1*a* and 2*a* of the guitar 1 or the amplifier 2 and provided at a center thereof with a through-hole 112 formed in a longitudinal direction; a signal terminal 120 fixed to the cover member 110 and protruding toward the fixing part 1*a* and 2*a*, such that the signal terminal 120 is electrically connected to a tip 212 when a front portion of the cable connecting jack 200 is inserted into the through-hole 112; a ground member 130 hinge-coupled in the cover member 110, provided at a front end thereof with a non-conductive contact roll 132 making contact with the tip 212 and the sleeve 214 of the cable connecting jack 200, and provided at a rear end thereof with a conductive ground connecting part 134 electrically making contact with the sleeve 214; and an elastic piece 140 provided in the cover member 110 to press the contact roll 132 toward the through-hole 112.

Hereinafter, each element constituting the socket according to the present invention will be described in more detail.

First, the cover member 110 is buried in the guitar 1 or the amplifier 2. The through-hole 112 is formed at the center of the body 111 of the cover member 110 in the longitudinal direction. A latch step 113 supported by a surface of the guitar 1 or the amplifier 2 is formed along a rear periphery of the cover member 110 and a coupling hole 113*a* is formed in the latch step 113, such that the cover member 110 is integrally fixed by using a coupling means 113*b* such as a screw.

A signal terminal 120, which is electrically connected to the tip 212 when the front portion of the cable connecting jack 200 is inserted therein, is fixed and installed to the cover member 110.

The signal terminal 120 may be formed of various conductive materials such as platinum, aluminum or copper. Specifically, the signal terminal 120 includes a V-shape protrusion part 121 for a signal connection that is formed at a front portion thereof to allow only the tip 212 of the cable connecting jack 200 to make contact with the protrusion part 121, and a supporting protrusion part 122 formed at a rear portion thereof and inserted into a supporting hole 115 in the cover member 110.

In this case, a latch step 122*a* is formed at an end of the supporting protrusion part 122 and supported by an escape preventing hole 115*a* communicating with the supporting hole 115, such that the signal terminal 120 is separated or escaped from the cover member 110 when the cable connecting jack 200 is inserted into the through-hole 112.

The signal terminal 120 is connected to a signal wire W1 and has elasticity, such that tension may be naturally applied to the tip 212 of the cable connecting jack 200 when the V-shape protrusion part 121 for signal connection makes contact with the tip 212.

Meanwhile, the ground member 130, which is coupled to the cover member 110 with a hinge pin 135, has the hinge hole 133 formed in a body 131 and is hinge-coupled into a fixing hole 111*a* of the cover member 110 with a hinge pin 135. The body 131 is provided at a front end thereof with the non-conductive contact roll 132 that makes contact with the tip 212 and the sleeve 214 of the cable connecting jack 200. The body 131 is provided at a rear end thereof with the conductive ground connecting part 134 that makes contact with the sleeve 214 and is connected to a ground wire W2.

In this case, the conductive ground connecting part 134 extends from a rear end of the body 131 of the ground member 130, so that the conductive ground connecting part 134 is formed integrally with the body 131. The non-conductive contact roll 132 is integrally formed at a front end of the body 131.

The conductive ground connecting part 134 is made of an elastic material. The conductive ground connecting part 134 has a curved shape such that the conductive ground connecting part 134 smoothly guides the connecting part 210 of the cable connecting jack 200 when the conductive ground connecting part 134 makes contact with the connecting part 210 of the cable connecting jack 200. The conductive ground connecting part 134 is electrically connected to a ground wire W2.

Meanwhile, first and second guide holes 118 and 119 are formed in the cover member (110) to communicate with the through-hole 112, such that the conductive ground connecting part 134 and the non-conductive contact roll 132 are introduced into or withdrawn from the through-hole 112.

A connecting protrusion part 137 is formed at a low end of the non-conductive contact roll 132 which is integrally fixed to a front end of the body 131 of the ground member 130 and is electrically connected to the body 131, such that the electrical connection of the connecting protrusion part 137 with the body 131 is maintained.

Meanwhile, the elastic piece 140, which presses the contact roll 132 toward the through-hole 112, is fixed to the cover member 110.

As described above, since the elastic piece 130 presses the contract roll 132, in state that the connecting jack 200 is not inserted into the socket 100, the contact roll 132 is pressed in the first guide hole 118, so that the contact roll 132 is maintained in state that the contact roll 132 protrudes toward the through-hole 112. If the connecting jack 200 is connected to the socket 100, the contact roll 132 is pressed inwardly in the first guide hole 118 to move back, so that the conductive ground connecting part 134 is pressed in the second guide hole 119 about the hinge pin 135 to protrude toward the through-hole 112.

In addition, in order to allow the socket to be used even though the guitar is an active type, the elastic piece 140, the elastic piece 140 is connected to a power source such as a 9V battery through an active wire W3. Thus, when the connecting jack 200 is connected to the socket 100, the contact roll 132 is pressed toward an inside of the first guide hole 118 in the through-hole 112 to move back, so that the contact roll 132 is electrically connected to the connecting protrusion part 137, so the contact roll 132 is electrically connected to the ground wire W2.

Figure 5:
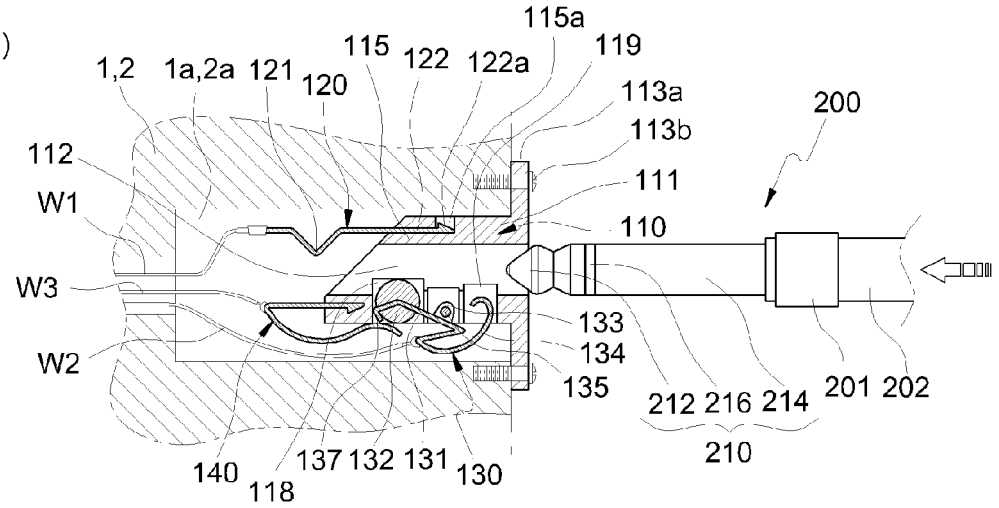
FIG. 5(*a*), FIG. 5(*b*), and FIG. 5(*c*) are views sequentially showing a procedure of connecting a connecting jack to the socket for a connecting jack having a structure for preventing a popping noise according to the present invention.
Figure 5:
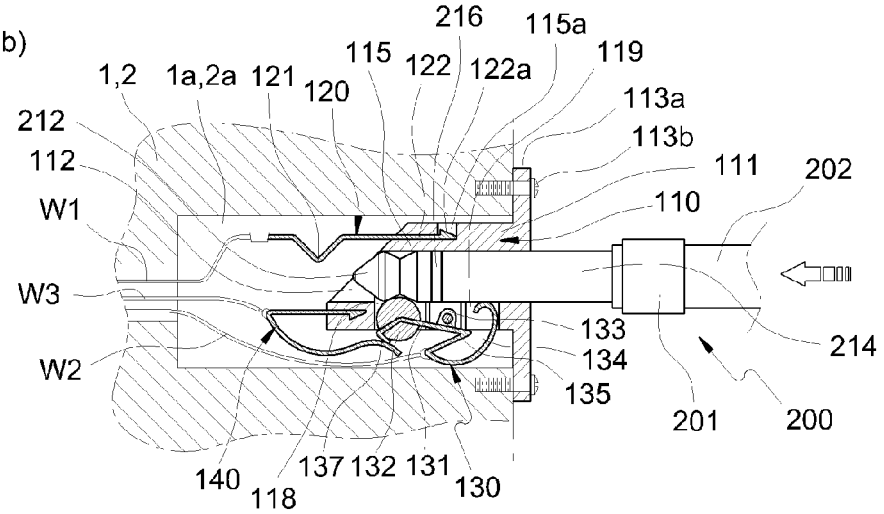
Figure 5:
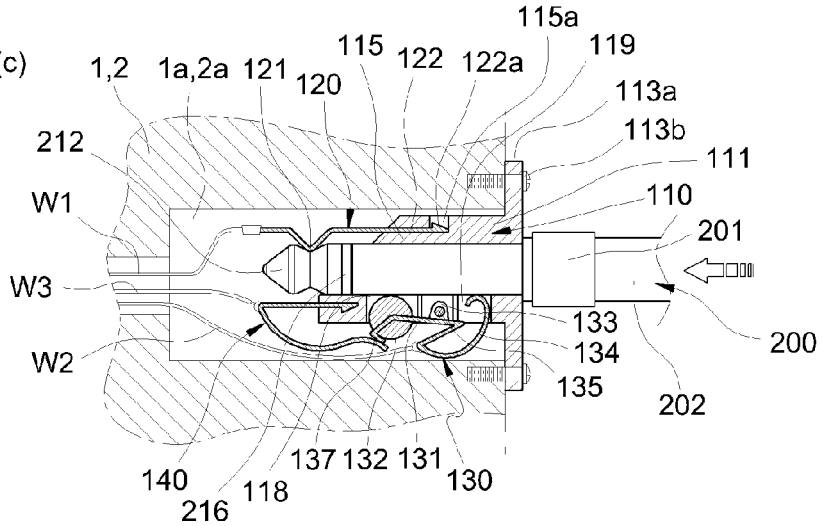

Hereinafter, an example of using the socket for a connecting jack having a structure of preventing a popping noise according to the present invention will be described with reference to FIGS. 1 to 5.

According to the socket 100 for a connecting jack of the present invention, since the elastic piece 140 presses the contact roll 132 before the connecting jack 200 is connected to the guitar 1 or the amplifier 2, the contact roll 132 is pressed in the first guide hole 118, so that the contact roll 132 is maintained in state that the contact roll 132 protrudes toward the through-hole 112.

In this case, the conductive ground connecting part 134 is placed in the second guide hole 119 and is maintained in state that the conductive ground connecting part 134 does not protrude toward the through-hole 112.

In this state, when the connecting part 210 of the connecting jack 200 is pushed into the through-hole 112, while the tip 212 makes contact with the contact roll 132, the tip 212 presses the contact roll 132 so that the contact roll 132 moves back into the first guide hole 118 in the through-hole 112. In this case, the conductive ground connecting part 134 is pressed in the second guide hole 119 about the hinge pin 135, so that the conductive ground connecting part 134 makes contact with the sleeve 214 of the connecting jack 200 while protruding toward the through-hole 112.

That is, since the ground contact occurs prior to a signal contact, the popping noise is not generated.

Then, when the connecting part 210 of the connecting jack 200 is pushed into the through-hole 112 to the end thereof, it is maintained that the contact roll 132 and the conductive ground connecting part 134 make contact with each other together with the sleeve 214 of the connecting jack 200. In this case, the elastic piece 140 connected to the active wire W3 is electrically connected to the connecting protrusion part 137 to electrically communicate with the ground wire W2.

Thereafter, when the connecting part 210 of the connecting jack 200 is separated from the through-hole 112, the contact roll 132 is pressed due to the restoring force of the elastic piece 140, so that the contact roll 132 is pressed in the first guide hole 118. Thus, it is maintained that the contact roll protrudes toward the through-hole 112.

Although the present invention has been described by making reference to the embodiments and accompanying drawings, it should be understood that the present invention is not limited to the embodiments but includes all modifications, equivalents and alternatives. Accordingly, those skilled in the art should understand the spirit and scope of the present invention as defined in the following claims. In addition, those skilled in the art should understand that the equivalents and the modifications belong to the scope of the spirit of the present invention.

What is claimed is:

1. A socket for a connecting jack having a structure of preventing a popping noise, wherein the connecting jack includes a connecting part including a tip having an end of a cone shape to perform a function of transmitting a signal through a cable and a sleeve having a cylindrical shape to perform a ground function, and wherein the connecting jack is inserted into the socket of a guitar or an amplifier, the socket comprising:

a cover member buried in a fixing part of the guitar or the amplifier and provided at a center thereof with a through-hole formed in a longitudinal direction;

a signal terminal fixed to the cover member and protruding toward the fixing part, such that the signal terminal is electrically connected to the tip when a front portion of the cable connecting jack is inserted into the through-hole;

a ground member hinge-coupled in the cover member, provided at a front end thereof with a non-conductive contact roll making contact with the tip and the sleeve of the cable connecting jack, and provided at a rear end thereof with a conductive ground connecting part electrically making contact with the sleeve; and an elastic piece provided in the cover member to press the contact roll toward the through-hole.

2. The socket of claim 1, wherein the signal terminal is connected to a signal wire, formed at a front portion thereof with a V-shape protrusion part for a signal connection that makes contact with the tip of the connection jack, and formed at a rear portion thereof with a supporting protrusion part inserted into a supporting hole formed in the cover member.

3. The socket of claim 1, wherein first and second guide holes are formed in the cover member to communicate with the through-hole, such that the conductive ground connecting part and the non-conductive contact roll are introduced into or withdrawn from the through-hole, wherein the ground member is formed in a body thereof with a hinge hole so that the ground member is hinge-coupled into a fixing hole of the cover member through a hinge pin, wherein the body is provided at a front end thereof with the non-conductive contact roll that makes contact with the tip and the sleeve, and wherein the body is provided at a rear end thereof with the conductive contact roll that makes contact with the sleeve and is connected to a ground wire.

4. The socket of claim 1, further comprising a connecting protrusion part formed at a low end of the non-conductive contact roll integrally fixed to a front end of a body of the ground member, wherein the connecting protrusion part is electrically connected with the body such that the connecting protrusion part is enabled to make electrical contact with the elastic piece.

5. The socket of claim 1, wherein the elastic piece is connected to an active wire such that the elastic piece is usable in an active guitar.

* * * * *